US010767845B2

(12) United States Patent
King et al.

(10) Patent No.: US 10,767,845 B2
(45) Date of Patent: Sep. 8, 2020

(54) CORE TROFFER SNAP IN AND GROUNDING ASSEMBLY

(71) Applicant: SIGNIFY HOLDING B.V., Eindhoven (NL)

(72) Inventors: Dustin King, Mooreville, MS (US); Gary Lauderdale, Tupelo, MS (US); Carlton Bruce Plunk, Saltillo, MS (US); Christopher Patrick Warner, Hamilton, AL (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/331,484

(22) PCT Filed: Sep. 15, 2017

(86) PCT No.: PCT/EP2017/073231

§ 371 (c)(1),
(2) Date: Mar. 7, 2019

(87) PCT Pub. No.: WO2018/054763

PCT Pub. Date: Mar. 29, 2018

(65) Prior Publication Data

US 2019/0219257 A1 Jul. 18, 2019

Related U.S. Application Data

(60) Provisional application No. 62/398,226, filed on Sep. 22, 2016.

(30) Foreign Application Priority Data

Oct. 25, 2016 (EP) ..... 16195541

(51) Int. Cl.
*F21V 25/00* (2006.01)
*F21V 15/015* (2006.01)
(Continued)

(52) U.S. Cl.
CPC ..... *F21V 25/00* (2013.01); *F21S 8/026* (2013.01); *F21V 15/01* (2013.01); *F21V 15/015* (2013.01);
(Continued)

(58) Field of Classification Search
None
See application file for complete search history.

(56) References Cited

U.S. PATENT DOCUMENTS 5,493,098 A 2/1996 Diederich
6,079,851 A 6/2000 Altman et al.
(Continued)

FOREIGN PATENT DOCUMENTS

CN 101479826 A 7/2009
CN 102159884 A 8/2011
(Continued)

*Primary Examiner* — Britt D Hanley
(74) *Attorney, Agent, or Firm* — Daniel J. Piotrowski

(57) ABSTRACT

The invention provides a troffer-based lighting arrangement (100) comprising end plates (1100) and a lighting unit (1200) configured between said end plates (1100), wherein the lighting unit (1200) comprises a grounding point (1207) and head ends, wherein the end plates (1100) are associated with the respective head ends via connectors (1300), wherein the lighting unit (1200) and end plates (1100) are in physical contact with each other for providing grounding continuity between the lighting unit (1200) and the end plates (1100), and which connectors (1300) comprise head end locking tabs and end plate locking slots (1103), wherein the locking tabs reside in the respective locking slots (1103).

11 Claims, 8 Drawing Sheets

(51) Int. Cl.

| | |
|---|---|
| ***F21V 21/04*** | (2006.01) |
| ***F21V 23/00*** | (2015.01) |
| ***F21V 15/01*** | (2006.01) |
| ***F21S 8/02*** | (2006.01) |
| ***F21V 23/06*** | (2006.01) |

(52) U.S. Cl.
CPC ..... *F21V 21/04* (2013.01); *F21V 23/00* (2013.01); *F21V 23/06* (2013.01)

(56) References Cited

U.S. PATENT DOCUMENTS

| | | | | |
|---|---|---|---|---|
| 6,217,190 | B1 * | 4/2001 | Altman ..... | H01R 33/0818 362/221 |
| 6,218,782 | B1 | 4/2001 | Mallalieu | |
| 9,146,027 | B2 | 9/2015 | Zantout et al. | |
| 2002/0118544 | A1 | 8/2002 | Wang | |
| 2010/0091484 | A1 | 4/2010 | Mayfield et al. | |

FOREIGN PATENT DOCUMENTS

| | | | |
|---|---|---|---|
| CN | 201973532 | U | 9/2011 |
| CN | 103946630 | A | 7/2014 |
| CN | 104041204 | A | 9/2014 |
| CN | 204026208 | U | 12/2014 |
| CN | 204328522 | U | 5/2015 |
| CN | 104776406 | A | 7/2015 |
| DE | 202009016317 | U1 | 4/2011 |
| JP | 10162605 | A | 6/1998 |
| WO | 8907734 | A1 | 8/1989 |
| WO | 2015132177 | A1 | 9/2015 |

* cited by examiner

CORE TROFFER SNAP IN AND GROUNDING ASSEMBLY

CROSS-REFERENCE TO PRIOR APPLICATIONS

This application is the U.S. National Phase application under 35 U.S.C. § 371 of International Application No. PCT/EP2017/073231, filed on Sep. 15, 2017, which claims the benefit of Provisional Patent Application Application No. 62/398,226, filed on Sep. 22, 2016, which claims the benefit of European Patent Application No. 16195541.4, filed on Oct. 25, 2016. These applications are hereby incorporated by reference herein.

FIELD OF THE INVENTION

The invention relates to a troffer-based lighting arrangement which comprises a troffer and a lighting unit. The invention also relates to the method of assembling of such lighting arrangement, as well as to the respective troffer and lighting unit, respectively. Yet further, the invention also relates to a lighting system including such troffer-based lighting arrangement.

BACKGROUND OF THE INVENTION

Troffer-based lighting assemblies or troffer-based lighting arrangements are known in the art. U.S. Pat. No. 6,218,782, for instance, describes a lighting fixture assembly, comprising a troffer having an electrically conductive surface, first and second electrical sockets mounted on the electrically conductive surface of said troffer and positioned for supporting a fluorescent lamp there between, an electronic ballast mounted on the electrically conductive surface of said troffer and including lamp ballasting circuitry, said lamp ballasting circuitry electrically connected to the first pair of lamp pins via the first electrical socket and electrically grounded to the conductive troffer surface, the second pair of lamp pins electrically connected to the conductive surface of the troffer via said second electrical socket, said troffer providing an electrically conductive path back to said lamp ballasting circuitry.

SUMMARY OF THE INVENTION

UL (Underwriters Laboratories) safety regulations require safety implementations where all metal in a recessed luminaire is to be grounded if it is accessible by the customer or installer. This requires grounding continuity between "accessible dead metal" and the incoming grounding point located on the access plate. Grounding continuity is important to the safety of the product. If there is a short to the metal of the luminaire then it can discharge to the ground point through the metal parts of the luminaire rendering it safe from electrical shock. Historically, this is accomplished using screws, insulated copper wire, or other fastening methods, such as welding. This has an additional cost for assembly and material to the luminaire. Amongst others, this may include an additional action, imposing additional costs and additional possibilities of errors. Alternative methods, if any seem to be rather complex which has also disadvantages.

Hence, it is an aspect of the invention to provide an alternative lighting arrangement, which preferably further at least partly obviates one or more of above-described drawbacks. It is also an aspect of the invention to provide an alternative method of assembling such (alternative) lighting arrangement, which preferably further at least partly obviates one or more of above-described drawbacks.

If ground continuity would (already) be achieved during the assembly of the luminaire, the cost of material and labor can be reduced. However, also safety might improve.

Amongst others, in the present invention the light engine assembly (herein also indicated as lighting unit) may be positioned in the center of the luminaire. The accessible end and side panels especially have ground continuity. The (LED light) engine assembly installs into the luminaire via locking tabs to secure the assembly into the luminaire. In this way, the troffer-based lighting arrangement may easily be assembled, without additional actions (like subsequently bending, welding, or screwing elements). The light engine may, amongst others, ground on the (interference) lances (herein also indicated as protruding elements) on the end plate where pressure from the locking tabs will provide pressure against these (interference) lances to achieve ground continuity. Further, optionally a catch tab may be provided, e.g. located on the end plate, which, with the lighting unit in final position (herein also indicated as engaged state), will be positioned into a cut out in e.g. the light engine assembly, especially to provide an additional ground point and/or support for the light engine assembly.

Hence, in a first aspect the invention provides a troffer-based lighting arrangement comprising end plates and a lighting unit configured between said end plates, wherein the lighting unit comprises a grounding point, wherein the lighting unit comprises head ends, wherein the end plates are associated with the respective head ends via connectors, wherein the lighting unit and end plates are in physical contact with each other for providing grounding continuity between the lighting unit and the end plates (and the grounding point), and which connectors comprise (head end) locking tabs and (end plate) locking slots, wherein the locking tabs reside in the respective locking slots.

Such arrangement can be relatively easily assembled, whereas grounding continuity is also essentially guaranteed, without the necessity of additional actions such as screwing, welding, or bending elements to one another. Hence, accessible parts, such as e.g. the end plates or the housing of the lighting unit or side elements of the troffer (see below) can have grounding continuity. The troffer, comprising the end plates, engages the lighting unit and the connectors keep the lighting unit and troffer connected. The connection is in principle a one-way connection in the sense that after assembly, the troffer-based lighting arrangement may not be disassembled into separate end plates and lighting unit without essentially bending, breaking, or removing material.

As indicated above, the invention provides a troffer-based lighting arrangement. Such arrangements are known in the art, see also above cited prior art.

Herein, the term "troffer-based lighting arrangement" relates to an arrangement that may essentially be a single integral unit consisting of a plurality of components, amongst others the end plates and the lighting unit. Hence, the term "troffer-based lighting arrangement" may refer to the (functional) combination of troffer and lighting unit.

The term "troffer" is derived from a combination of trough and coffer, and in general may merely refer to the box-like fixture used to mount fluorescent tubes or solid state lighting units. The trough is the space, such as a concavity, essentially formed by the sides and ends (herein indicated as end plates) of the troffer.

The troffer may have a back plate. Alternatively, (or additionally), the lighting unit (at least partly enclosed by the troffer) may include a back plate. Hence, one or more of the lighting unit and troffer may provide a back plate for the troffer-based lighting arrangement.

The back plate (of e.g. the troffer) is commonly used to attach a ballast and/or control unit, which is/are mounted within the trough of the troffer. A ballast may be a necessary element for e.g. fluorescent lighting. The back plate may sometime be used as a base to mount the troffer lighting arrangement directly to the ceiling, or to other mounting means such as wires, a decorative box, or stanchions. However, in other embodiments the troffer may be recessed within a ceiling. In this way, e.g. a diffuser (lamellas) is coplanar with the ceiling surface. The invention is not limited to specific configuration of the troffer-based lighting arrangement to a ceiling or another element. The back plate may be in grounding continuity with the grounding point (see also below).

Note however that the troffer may not be limited to specific configurations, except for including at least a single end plate, in general two end plates. Note that the invention may also be defined in relation to a single end plate and another further end plate, or to a plurality (two, but optionally also more than two) of end plates. Here below, the invention is thus (further) defined in relation to two end plates. Hence, many definitions that given while referring to a plurality of elements may also refer to a single element, or single combination, or single connecter, etc., unless indicated otherwise or clear from the description.

The end plates may have any shape, though in general they will be (macroscopically) flat. The end plates especially (also) include connector elements for providing a connection with the head ends of the lighting unit (see also below).

The end plates may especially be physically connected to one or more bridging parts. Thereby, a frame is provided in which the lighting unit may be arranged. Especially, the bridging parts are also in grounding continuity with the end elements. The bridging part may in embodiments comprise e.g. reflectors. Therefore, in embodiments the troffer may comprise side elements and said end plates defining a trough-like space for engaging at least part of said lighting unit, which side elements and end plates together optionally form a fully circumferential wall around the trough. Especially, the side elements comprise light reflective faces. Additionally or alternatively a respective reflective face optionally is comprised in each head end, said reflective faces of the head ends facing towards each other.

The lighting unit especially includes a housing and a light source, which is especially associated with the housing. The housing may at least partly enclose the light source. The housing may include one or more reflectors for reflecting light of the light source. Further, the housing may include one or more (other) optical components for modifying the light of the light source and/or a beam shape of the light source light. The lighting unit may include further components like e.g. an electrical wire, a sensor, etc.

In embodiments, the term "light source" refers to a fluorescent lamp, such as a tubular fluorescent lamp, such as a T5 or T8 fluorescent tube. In yet other embodiments, the term "light source" refers to a solid state light source (such as a LED or laser diode).

The term "light source" may also relate to a plurality of light sources, such as 2-200 (solid state) LED light sources. Hence, the term LED may also refer to a plurality of LEDs. Further, the term "light source" may in embodiments also refer to a so-called chips-on-board (COB) light source. The term "COB" especially refers to LED chips in the form of a semiconductor chip that is neither encased nor connected but directly mounted onto a substrate, such as a PCB. Hence, a plurality of semiconductor light sources may be configured on the same substrate. In embodiments, a COB is a multi LED chip configured together as a single lighting module.

As indicated above, the lighting unit (at least partly enclosed by the troffer) may include a back plate. The lighting unit further includes a grounding point. The grounding point may in embodiments be a part on the light source that is e.g. accessible to the housing of the lighting unit and which may be (during use or permanently) in grounding continuity with a socket or plug having grounding functionality. For instance, such grounding point may be in grounding continuity with third prong ("ground") of an electrical cable of the lighting arrangement or a grounding pin (or "ground pin") of a socket of the lighting arrangement, a luminaire electrical access attachment plate (see also below), an earth ground, a(n earthed) conduit (flexible or rigid) etc.

Herein, the term "grounding continuity" especially refers to an essentially electrically conductive connection between two (or more) items. Would there be a short to one of the items, then a grounding of one or more of the other items will lead to a ground and thus (essentially) safe situation. Hence, the term "grounding" continuity does not necessarily include that an item is grounded, but indicates that when an item is grounded, any other item that is in grounding continuity with the item is also grounded.

The grounding point of the lighting unit may be based on conventional technologies such as used for fluorescent tubes, like for instance a (luminaire) electrical access attachment plate or sometimes also indicated as access plate or luminaire electrical access plate. Likewise, the grounding continuity of the housing of the lighting unit may be based on conventional technologies such as used for fluorescent tubes and is also known to a person skilled in the art.

The lighting unit includes head ends, of which at least part have a shape corresponding to the shape of at least parts of the end plate; or, the other way around, the end plates include parts that have a shape corresponding to at least part of the head ends of the lighting unit. In this way a fit between the two elements may be provided, especially an interference fit. The end plates and lighting unit may in this way be associated to each other. Further, such interference fit may provide grounding continuity. Yet further, the interference fit may imply that when the lighting unit is engaged by the troffer, the head ends of the lighting unit and the end plates scratch. Hence, the end plates may be associated with the respective head ends via connectors. Especially, the lighting unit and end plates are in physical contact with each other. Due to this association, grounding continuity may be provided between the lighting unit and the end plates. Therefore, in embodiments the lighting unit and said end plates may be configured in interference fit for providing grounding continuity between the lighting unit and the end plates. An interference fit, also known as a press fit or friction fit, is a fastening between two parts which is achieved by friction after the parts are pushed together, rather than by any other means of fastening.

The head ends especially (also) include connector elements for providing a connection with the end plates (of the troffer) (see also below). Hence, in essence the end plates and lighting unit include connector elements that are configured to provide connectors between the end plates and lighting unit. The connector elements especially include corresponding locking tabs and locking slots. Other or further embodiments, such as catching tabs, are also possible, see below. Hence, the head ends of the lighting unit may include one or more connector elements and the end plates may comprise one or more corresponding connector elements, thereby providing connectors when the lighting unit is configured in the engaged state between the end plates. The head end may comprise one or more locking slots and/or one or more locking tabs. Likewise, the end plates may comprise one or more corresponding locking tabs and/or locking slots. Especially, herein configurations are described wherein the end plates include locking slots and the head ends include corresponding locking tabs. In this way, connectors are provided associating the end plates and the lighting unit (for facilitating the grounding continuity). Hence, in embodiments the connectors comprise head end locking tabs and end plate locking slots, wherein—in the associated state of the end plates and lighting unit—the locking tabs reside in the respective locking slots. As indicated above, in yet an alternative embodiment the connectors comprise head end locking slots and end plate locking tabs, wherein—in the associated state of the end plates and lighting unit—the locking tabs reside in the respective locking slots. When arranging the lighting unit and end plates to each other, the locking tabs snap at a certain position into the locking slots, and reside therein, thereby providing essentially permanent connectors. As indicated above, the troffer-based lighting arrangement may not be disassembled into separate end plates and lighting unit without essentially bending, breaking, or removing material.

The locking slots comprise one or more of recessions and through openings, especially through-openings. The locking tabs especially comprise a resilient material, such as a polymeric material. The locking tabs do not necessarily include springs. In specific embodiments the locking tabs do not include springs. Especially, the locking tabs include a (resilient) element protruding from the end plates or head end, especially from the head, to be received by the recession or through opening of the corresponding head end or end plate, especially end plate. For instance, the locking tab may include a polymeric nob, such as an ABS or PE nob. The locking tabs may e.g. include wall parts of the head end and/or parts of the end plate that is partly punch. Such part may be provided with a polymeric nob, with increasing height (i.e. increasingly protruding). When sliding the lighting unit into the troffer, the parts that are partly punched may be pushed back due to their flexibility, to snap with the protruding part, into the slot. In this way, the locking tab resides into the locking slot.

The invention also provides the troffer per se. Hence, in yet a further aspect the invention also provides a troffer, wherein in embodiments the troffer especially comprises side elements and end plates defining a trough-like space for engaging at least part of a lighting unit, wherein the end plates comprise (end plate) locking slots for engaging locking tabs comprised by said lighting unit.

Note that in alternative embodiments the end plates may comprise (end plate) locking tabs to be engaged by locking slots comprised by said lighting unit.

Likewise, the invention also provides the lighting unit per se. Hence, in yet a further aspect the invention also provides a lighting unit comprising a grounding point and head ends, wherein in embodiments the head ends comprise head end locking tabs for protruding locking slots of a troffer, which troffer comprises end plates, and which troffer is configured to engage at least part of said lighting unit.

Note that in alternative embodiments the head ends may comprise (head end plate) locking slots that can engage locking tabs comprised by said end plates.

Further, note that also combinations of different embodiments may be applied, such as locking tabs and corresponding locking slots on the head ends and end plates, respectively, and locking tabs and corresponding locking slots on the end plates and head ends, respectively.

In specific embodiments the end plates comprise protruding elements that protrude from the end plates and which are configured in interference fit with the lighting unit for providing grounding continuity between the lighting unit and the end plates. Such protruding elements may be (flexible) stops which engage the lighting unit when the lighting unit is arranged between the end plates. Hence, when the lighting unit is configured between the end plates with the locking tabs in the locking slots, the protruding elements push against the lighting unit. In this way the lighting unit is additionally held in place and physical contact is (further) ensured. The protruding elements and lighting unit may be configured such that dimensions of the lighting unit only allow an engaged state when the protruding elements push against the lighting unit, or, due to the fixation of the lighting unit with the connectors including the locking tabs and locking slots, pushes the lighting unit against the protruding element. Thereby, an interference fit is provided. The protruding elements may especially be lances or tabs, having a protruding width selected from the range of 2-50 mm, and length (such as parallel to the end plate or head end) selected from the range of 2-200 mm. In general, the length will be larger, such as at least twice as large, as the protruding width. The thickness of the protruding elements may the thickness of a plate use for the head or the end plate, such as selected from the range of about 0.5-4 mm, like about 0.6-0.85 mm.

Hence, in specific embodiments the invention provides embodiments (of the troffer), wherein the end plates comprise protruding elements that protrude from the end plates and which are configured for an in interference fit with the lighting unit, especially for providing grounding continuity between the lighting unit and the end plates.

Therefore, in further embodiments the invention also provides embodiments (of the lighting unit), wherein the housing is dimensioned such that the housing is configured for an interference fit with the end plates comprising protruding elements, especially for providing grounding continuity between the lighting unit and the end plates.

Hence, especially these protruding elements or lances may (further) provide a grounding continuity between the lighting unit, especially the head ends (of the housing), and the end plates. In this way accessible end plates are safe.

Note that in alternative specific embodiments the invention provides embodiments, wherein the head ends comprise protruding elements that protrude from the head ends and which are configured for an in interference fit with the end plates, especially for providing grounding continuity between the lighting unit and the end plates.

The end plates and lighting unit include connectors for associating the lighting unit and the end plate and provide an engaged stage with the tabs in the slots. Hence, connectors connect the end plates and the lighting unit. The physical contact may provide grounding continuity. Further, the protruding elements, which may also be indicated as grounding tabs or grounding lances, are especially configured to push against the lighting unit/receive pressure from the lighting unit, thereby also providing physical contact between the end plates and lighting unit. Also this physical contact may provide grounding continuity.

Further, in embodiments an additional connector may be provided. Such additional connector may be included (i) for safety reasons, e.g. would the connector(s) based locking tab and locking slot as defined above fail (in time), and/or (ii) may be included for further physical contact/further grounding continuity. Such connectors may e.g. comprise catching tabs and (corresponding) cut outs. These connectors may especially be configured to (further) hold the lighting unit in its place (engaged in the troffer). The use of catching tabs may include a bending of a part of a metal plate after the lighting unit and end plates are arranged to each other. By bending the catching tab into a cutout and additional connection between the end plates and lighting unit (head ends) may be provided. Therefore, in specific embodiments the lighting unit comprises a housing comprising cutouts, wherein the end plates comprise catching tabs, wherein the troffer-based lighting arrangement further comprises connectors and which connectors comprise said catching tabs and cutouts configured in physical contact (in the engaged state). Hence, the use of the catching tabs and cutouts may include an additional action (bending the catching tabs), but may also provide additional safety in terms of holding the lighting unit engaged and/or grounding continuity.

Hence, the invention provides also embodiments of the troffer, wherein the end plates further comprise catching tabs for providing together with cutouts in a housing of said lighting unit a physical contact configuration, especially for providing grounding continuity between the lighting unit and the end plates.

Yet further, the invention also provides embodiments of the lighting unit, comprising a housing, wherein the housing comprises cutouts for providing together with catching tabs of said troffer a physical contact configuration for providing grounding continuity between the lighting unit and the end plates.

Note that in alternative embodiments the head ends may comprise catching tabs and the end plates may comprise cut-outs, wherein the troffer-based lighting arrangement further comprises connectors and which connectors comprise said catching tabs and cutouts configured in physical contact (in the engaged state).

Also these connectors may provide grounding continuity between the lighting unit and the end plates. Yet further, these connectors are especially further configured to keep the lighting unit and end elements, i.e. the lighting unit and troffer, in its engaged state.

The end plates, head ends, side elements, housing (of the lighting unit), back plate, etc. are in general essentially metal plates, such as aluminum, optionally with a coating (including a lacquer). The interference fit of some of the elements with each other may allow a removal of part of the coating, thereby (further) facilitating grounding continuity.

As indicated above, the invention provides the troffer-based lighting arrangement. However, the invention also provides the troffer per se and/or the lighting unit per se. In yet a further aspect, the invention also provides a combination of these elements, especially for assembly into the troffer-based lighting arrangement. Hence, in yet a further aspect the invention also provides a kit of parts comprising one or more of said troffers as defined herein and one or more lighting units as defined herein, wherein at least one troffer and at least one lighting unit are configured to provide the troffer-based lighting arrangement as defined herein. Specific embodiments of such kit are also described herein in relation to the troffer-based lighting arrangement, the troffer or the lighting unit.

The troffer-based lighting arrangement may be part of or may be applied in e.g. office lighting systems, household application systems, shop lighting systems, home lighting systems, accent lighting systems, theater lighting systems, fiber-optics application systems, warning sign systems, medical lighting application systems, indicator sign systems, decorative lighting systems, portable systems, automotive applications, (outdoor) road lighting systems, urban lighting systems, green house lighting systems, horticulture lighting, etc. Hence, in yet a further aspect, the invention also provides a lighting system comprising the troffer-based lighting arrangement as described herein, wherein the lighting unit is in functional connection with an (external) electrical power system, and wherein the end plates, the lighting unit, and the head ends of the lighting unit are in grounding continuity with said grounding point. Such lighting system may be relatively safe, as any accessible part may be grounded. Specific embodiments of such lighting system are also described herein in relation to the troffer-based lighting arrangement, the troffer or the lighting unit.

The end plates and lighting unit may be assembled into the herein described troffer-based lighting arrangement. Hence, in a further aspect the invention also provides a method of assembling the troffer-based lighting arrangement, wherein the method may especially comprise providing the troffer as defined herein and the lighting unit as defined herein, moving the lighting unit into the trough-like space until the locking tabs reside in the respective locking slots. Further, as indicated above in specific embodiments the end plates may comprise protruding elements that protrude from the end plates, with the method further comprising moving the lighting unit into the trough-like space until the lighting unit is in an interference fit with protruding elements. Hence, before the locking tabs become in the state wherein the locking tabs are in the locking slots, force may have to be applied to push the lighting unit against the protruding elements until the locking tabs are in the locking slots. The lighting unit and end elements are in the engaged state and the protruding element pushes against the lighting unit (or especially the housing thereof).

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

DETAILED DESCRIPTION OF THE EMBODIMENTS

Figure 1A:
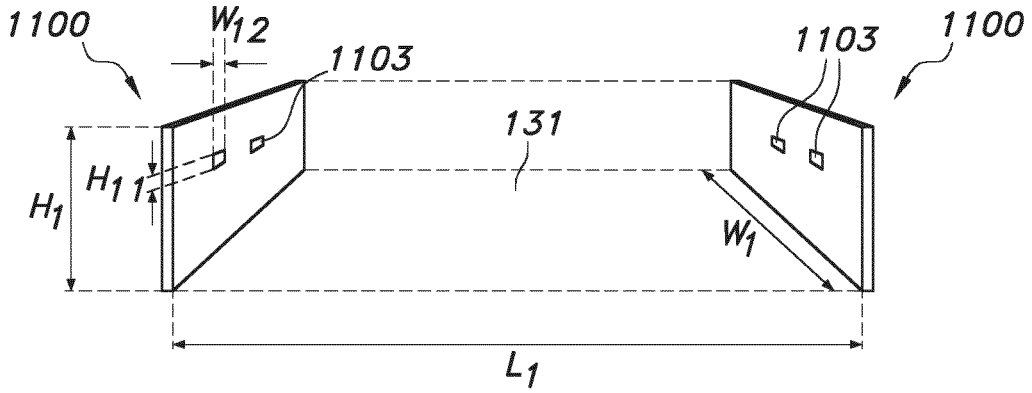
FIGS. 1*a*-1*d* schematically depict some aspects of the troffer-based lighting arrangement.

FIG. 1*a* schematically depicts two end plates 1100. There is a space in between, which can be a trough-like space, which is further herein indicated with reference 131. Possible bridging elements or side elements are not depicted in this schematic drawing. To associate the end plates and a lighting unit, connectors are provided connecting the end plates and lighting unit with each other. To this end the lighting unit and/or end plates may include locking tabs and corresponding locking slots. In FIG. 1*a* the end plates 1100 include locking slots 1103. By way of example, both end plates 1100 include two locking slots 1103. For instance, the locking slots may be rectangular having a height H11 and a width W12. The locking slots may be recessions or through openings. Herein, in general through openings are depicted. The end plates have a height H1 and a width W1. The distance between the end plates is indicated with reference L1. FIG. 1*a* is a perspective (side) view.

Figure 1B:
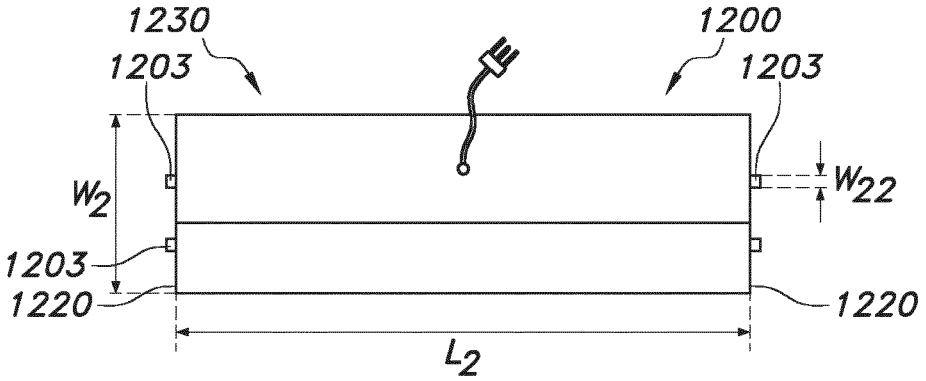

FIG. 1*b* schematically depicts a lighting unit 1200, seen from e.g. below. The lighting unit 1200 has a length L2 and a width W2. The length L2 will be essentially equal to the length L1 of the distance between the end plates L1, such as to provide an interference fit when the lighting unit 1200 is configured between the end plates 1100. Note that the end plates and head ends, indicated with reference 1203, of the lighting unit 1200 essentially have parts that have corresponding shapes. Hence, L1 and L2 may vary respectively over the end plates 1100 and head ends 1220 but vary over at least part correspondingly to provide an interference fit over at least part. Hence, in an engaged state, at least part of the respective end plates will have physical contact with at least part of the respective head ends 1220. The lighting unit 1200 may have a width W2, which may e.g. be smaller than the width W1 of the end plates. The head ends 1220 of the lighting unit 1200 may comprise corresponding connector elements. Here, locking tabs 1203 are depicted. As the end plates have by way of example two locking slots 1103, the head ends 1220 may also have two locking tabs 1203. The locking tabs 1203 may have a width W22. By way of example, a plug is schematically depicted, which will be in functional connection with a light source (not depicted; may be at the back side of the lighting unit 1200), and which can e.g. be plugged in a socket of the mains (see e.g. FIG. 4*d*).

Figure 1C:
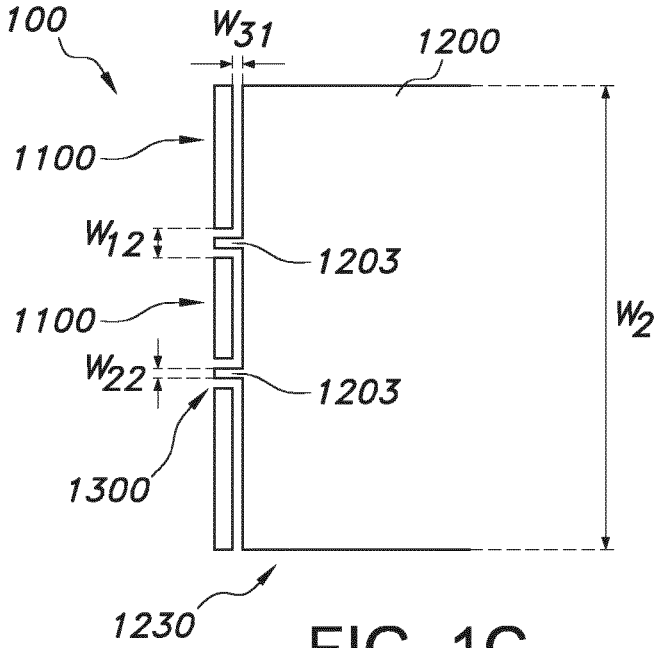

FIG. 1*c* schematically depicts in top view part of the troffer-based lighting arrangement 100 in top view, with the lighting unit 1200 and the end plates 1100 (here only one depicted) in the engaged state. The locking tabs 1203 reside in the locking slots 1103. Here, again the locking slots 1103 are schematically depicted as through openings (in the end plate 1100). Reference 1230 refers to a housing, which may be comprised by the lighting unit 1200, and which may house one or more light sources (not depicted).

The locking tabs 1203 reside in the respective locking slots 1103. The dimensions of the locking tabs 1203 and locking slots 1103 may be such that the locking tabs 1203 and locking slots 1103 fit to each other. The fit between the locking tabs and locking slots may be a clearance fit, or a transition fit, or an interference fit.

A clearance fit may allow movement of the one item fitted in the other item. For instance, a clearance fit for a shaft allowing rotation or sliding freely within a hole. A transition fit may be used when it is desirable that one item may exactly fit in the other item. For instance, a shaft being held precisely. Like with a clearance fit, the fit may not be so tightly that it cannot be disassembled. Another term for the transition fit is a location fit. As indicated above, with an interference fit one item is securely held in another item, and such fit may only be realized with some force. For instance, it may be desirable that a shaft is securely held within the hole. Hence, the dimensions of the locking slot 1103 may essentially identical to the dimensions of the locking tab. For instance, the width W12 of the locking slot may essentially be the same as the width W22 of the locking tab 1203. Likewise, this may apply to their heights.

Especially, the lighting unit 1200 and end plates 1100 are in physical contact with each other for providing grounding continuity between the lighting unit 1200 and the end plates 1100. Hence, the clearance W31 may be zero for one or more parts of the end plates 1100 and the lighting unit 1200.

Figure 1D:
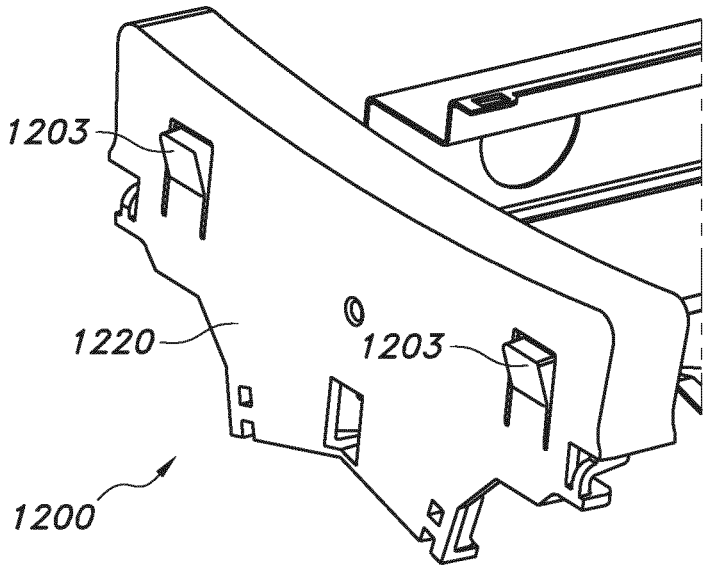

FIG. 1*d* schematically depicts the head end 1220 of the lighting unit 1200. Here, the head end 1220 comprises a lighting unit retainer, which is configured to retain the lighting unit in the troffer 130. To this end, the locking tabs 1203 are provided.

Figure 2A:
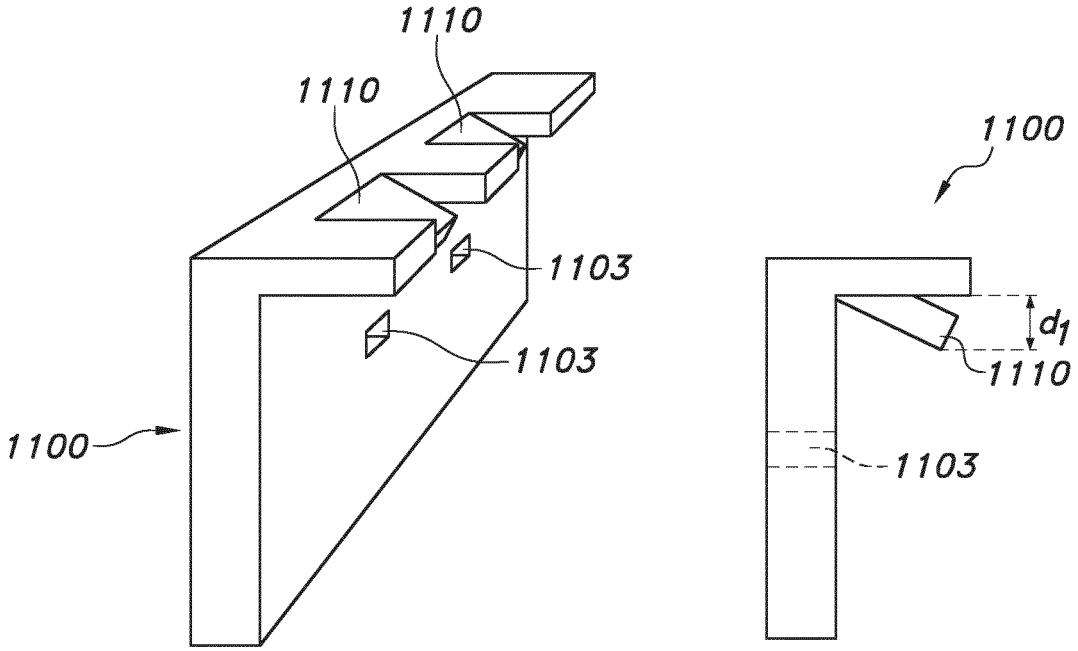
FIGS. 2*a*-2*c* schematically depict some aspects of the protruding element (lance)

FIG. 2*a* schematically depicts an embodiment wherein the end plate 1100 comprises one or more protruding elements 1110 that protrude from the end plate 1100. The protruding elements may also be indicated as "grounding tabs". Here, some elements are configured perpendicular to the end plate 1100, and some are configured under a non-perpendicular angle. The former might allow a clearance fit or location fit of the lighting unit. The latter may only allow an interference fit. Especially, one or more protruding elements 1110 are provided that only allow an interference fit of the lighting unit. The protruding elements 1110 may also be indicated as lances or grounding tabs. Would both types of protruding elements be available, there may be a (projected) height difference—in a planar view—between the end parts of the protrusions, indicated with d1. FIG. 2*a* schematically depicts a perspective view and a side view. In the side view, two protrusions are depicted (which are in reality thus one behind the other; see left view).

Figure 2B:
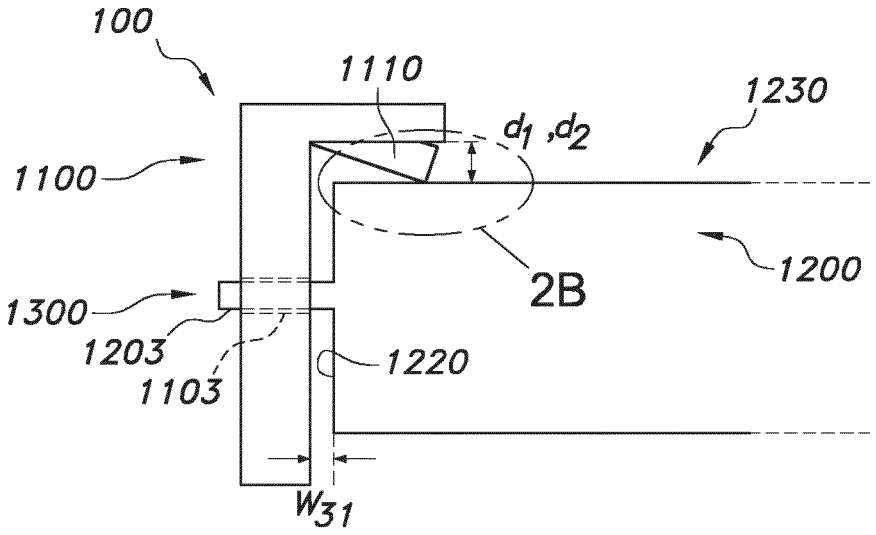
Figure 2C:
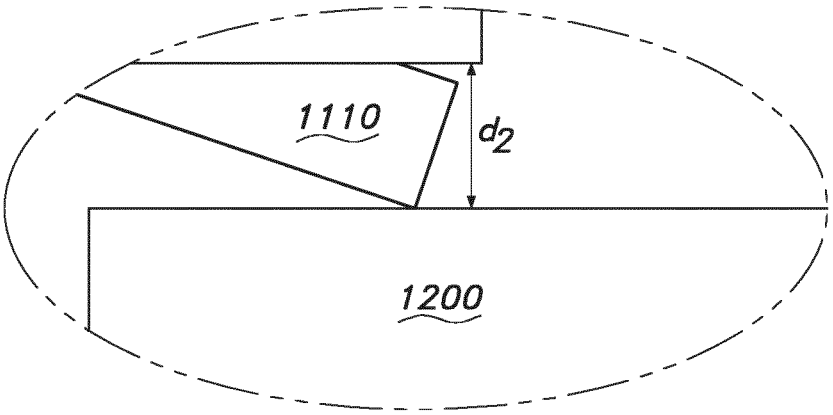

In FIG. 2*b*, also a side view, the lighting unit 1200 and the endplate 1100 are configured in the engaged state. The distance between the protrusion 1110 and the lighting unit 1200, such as the housing 1230 is indicated with d2. As there will be an interference fit, at one or more location d2=0 mm, and the protrusion 1110 and lighting unit are in physical contact. At such location(s) also d1=0 mm. In FIG. 2*b* d1 and d2 are only for the sake of drawing depicted as non-zero. In reality, at one or more locations d1=0 mm, d2=0 mm, and W31=0 mm. by way of example, of one such location a cross-sectional view is show in FIG. 2*c*, with d2=0 mm. The interference fit of the end plate 1100 with the lighting unit 1200 is especially used for providing grounding continuity between the lighting unit 1200 and the end plates 1100.

Figure 3A:
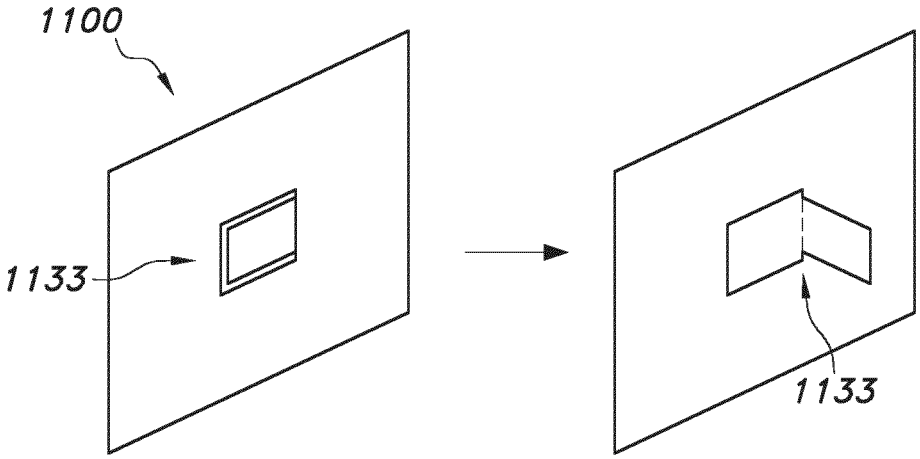
FIGS. 3*a*-3*c* schematically depict some aspects of a connector including a catch tab.
Figure 3B:
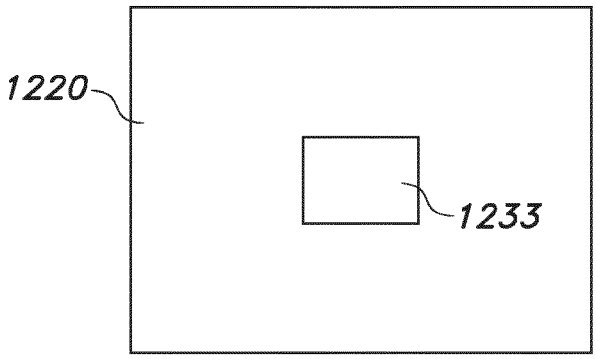
Figure 3C:
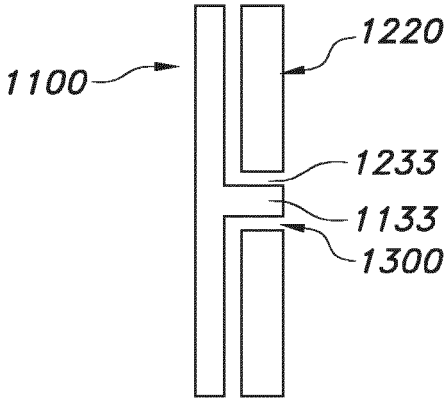

FIGS. 3*a*-3*c* schematically depict some aspects of a connector 1300 including a catch tab 1133. The catch tab may e.g. be obtained by partly stamping a part of a metal end plate. For instance, by stamping two edges of a triangle, or three edges of a rectangular part, from a plate, such as the head end or end plate, a part is provided that may be bent away from the plate. By bending the catching tab into a cutout and additional connection between the end plates and lighting unit (head ends) may be provided. This is schematically shown in FIG. 3*a*, here by way of example for the end plate 1100. FIG. 3*b* shows a corresponding plate with a cutout, here by way of example the head end 1220 of the lighting unit, with cutout 1233. FIG. 3*c* schematically depicts an embodiment with the catching tab and cutout in the engaged state. Hence, in embodiments of the troffer-based lighting arrangement 100, e.g. the end plate 1100 comprises a catching tab 1133 and the head end 1220 may comprise a cutout 1233 configured in physical contact. Hence, the troffer-based lighting arrangement 100 may further comprise connectors 1300 comprising said catching tabs 1133 and cutouts configured in an engaged configuration. These connectors 1300 may further provide grounding continuity between the lighting unit 1200 and the end plates 1100.

Figure 4A:
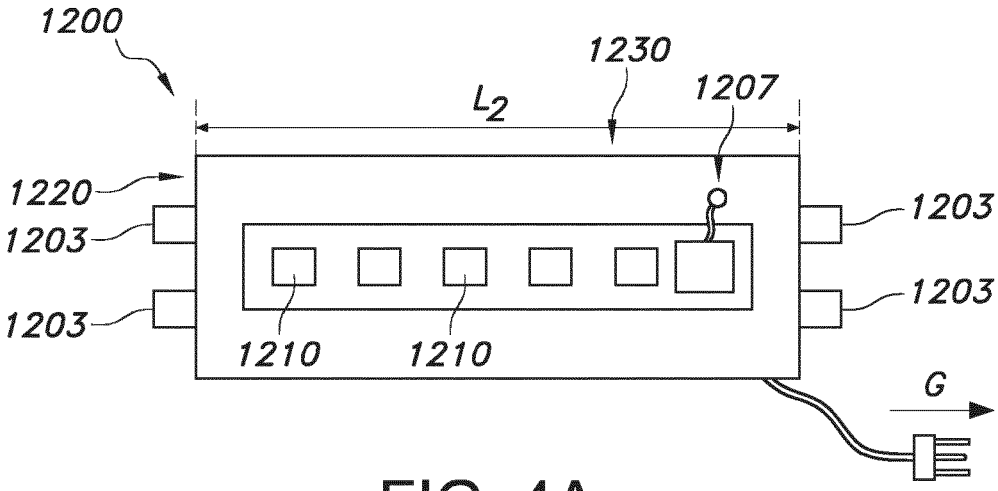
FIGS. 4*a*-4*h* schematically depict some further aspects of the troffer-based lighting arrangement.
Figure 4B:
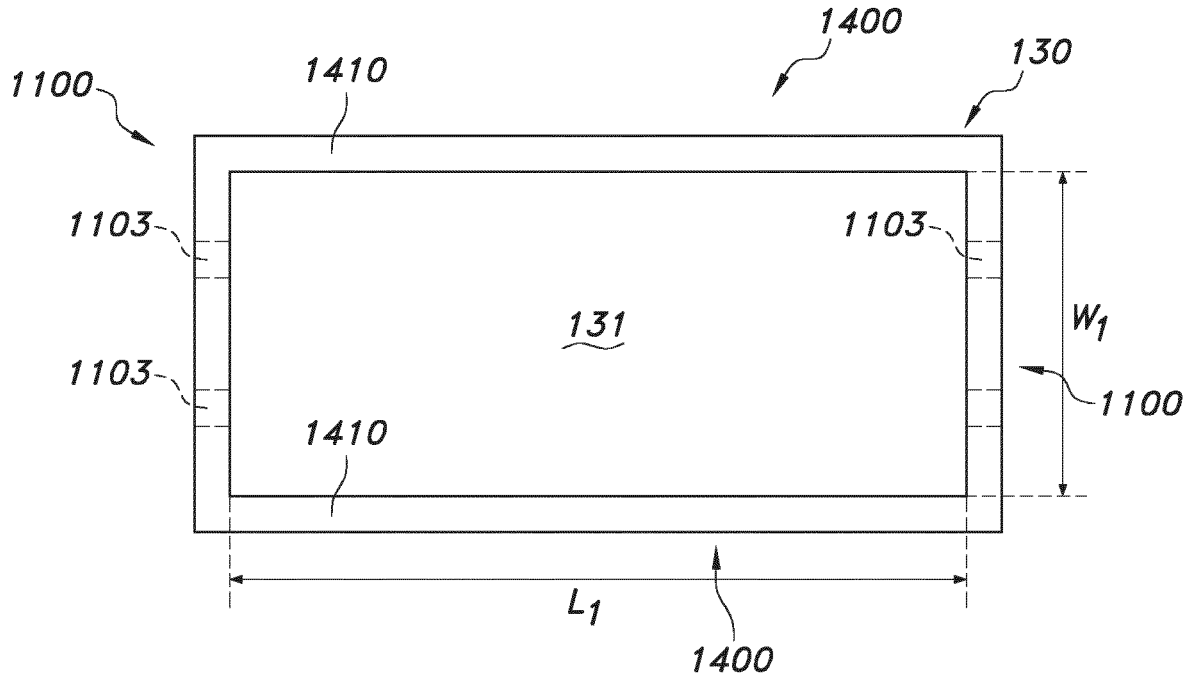
Figure 4C:
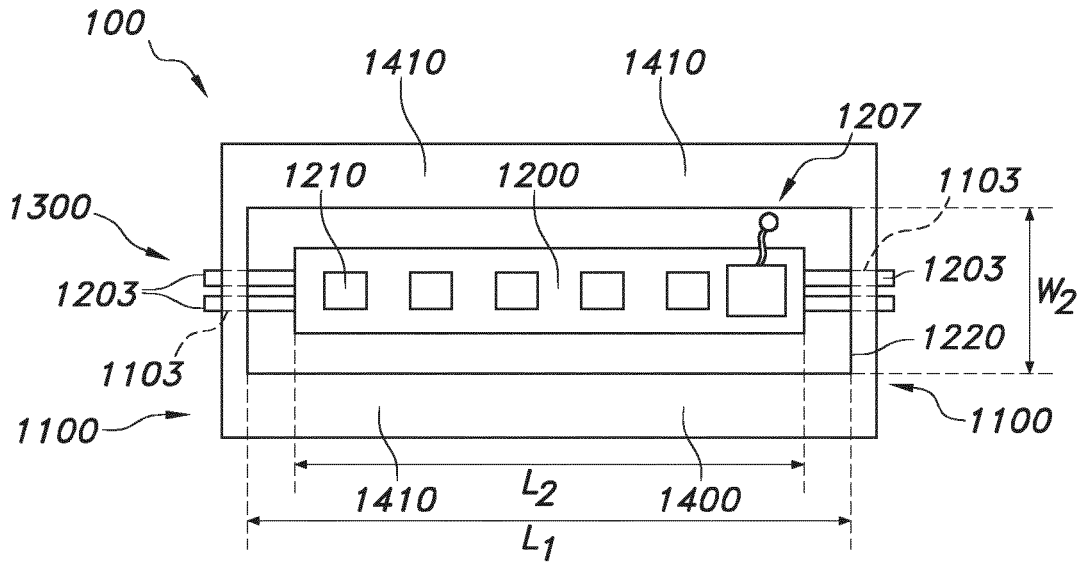
Figure 4D:
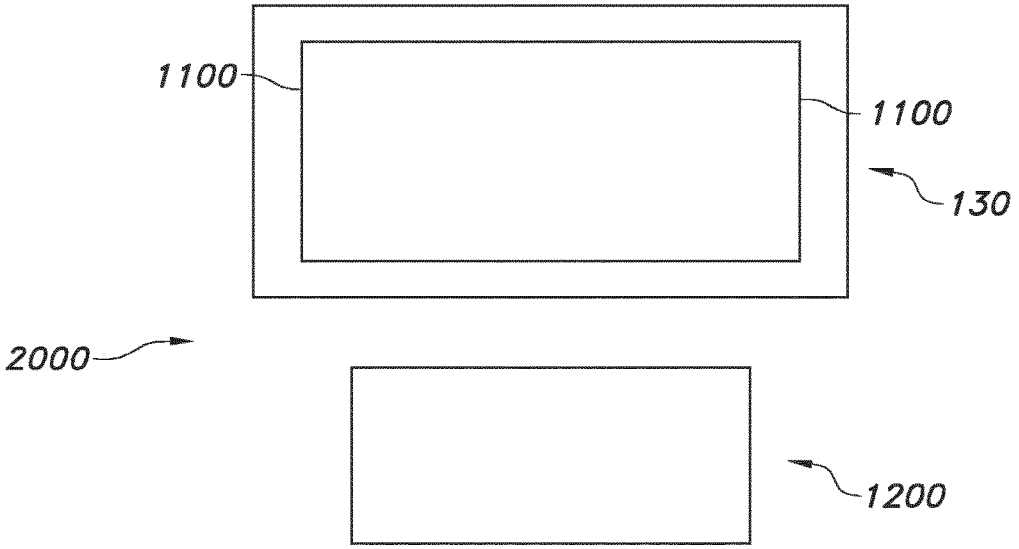

FIGS. 4*a*-4*d* schematically depict some further aspects of the troffer-based lighting arrangement 100. FIG. 4*a* schematically depicts an embodiment of the lighting unit 1200, with locking tabs 1203. The lighting unit 1200 comprises a housing 1230 and grounding point 1207. Here, the grounding via e.g. the mains (see reference G for grounding) may reach the accessible parts of lighting unit 1200. The grounding point may provide grounding continuity to the housing (of the lighting unit), the head ends (of the lighting unit) and the end plates (of the troffer). The grounding point 1207 can be a a screw attached to luminaire housing, or a screw attached to the luminaire electrical access attachment plate. Reference 1210 indicate a light source, such as a solid state light source. By way of example, the lighting unit 1200 comprises a plurality of light sources. FIG. 4*b* schematically depicts a troffer 130 including the end plates 1100 and side elements 1400, which may include reflective surfaces 1410. The side elements 1400 and end plates 1100 define a trough-like space 131 for engaging at least part of said lighting unit (see FIG. 4*c*). FIG. 4*c* schematically depicted the lighting unit 1200 and the troffer 130 in an engaged state. The lighting unit 1200 is in physical contact with the end plates 1100. In this top view, the protruding elements are not depicted. The length L2 of the lighting unit 1200 will be essentially the same as the distance L1 between the end plates 1100 (for providing an interference fit). Here, in this—by way of example schematically depicted—rectangular embodiment also the width W2 of the lighting unit 1200 may be essentially the same as the width W1 between the end plates 1100 of the troffer-based lighting arrangement 100. The light reflective surfaces 410 may be used for reflection of light of the light sources for providing beam shaped light (of the troffer-based lighting arrangement 100). As indicated above, the interference fit between the end plate 1100 and the lighting unit 1200 leads to scratching of the paint and creates thereby a permanent interference between the parts which insures continuity. FIG. 4*d* schematically depicts a kit of parts 2000 comprising one or more of said troffers (130) as defined herein and one or more lighting units 1200 as defined herein, wherein at least one troffer 130 and at least one lighting unit 1200 are configured to provide the troffer-based lighting arrangement 100 as defined herein.

Figure 4E:
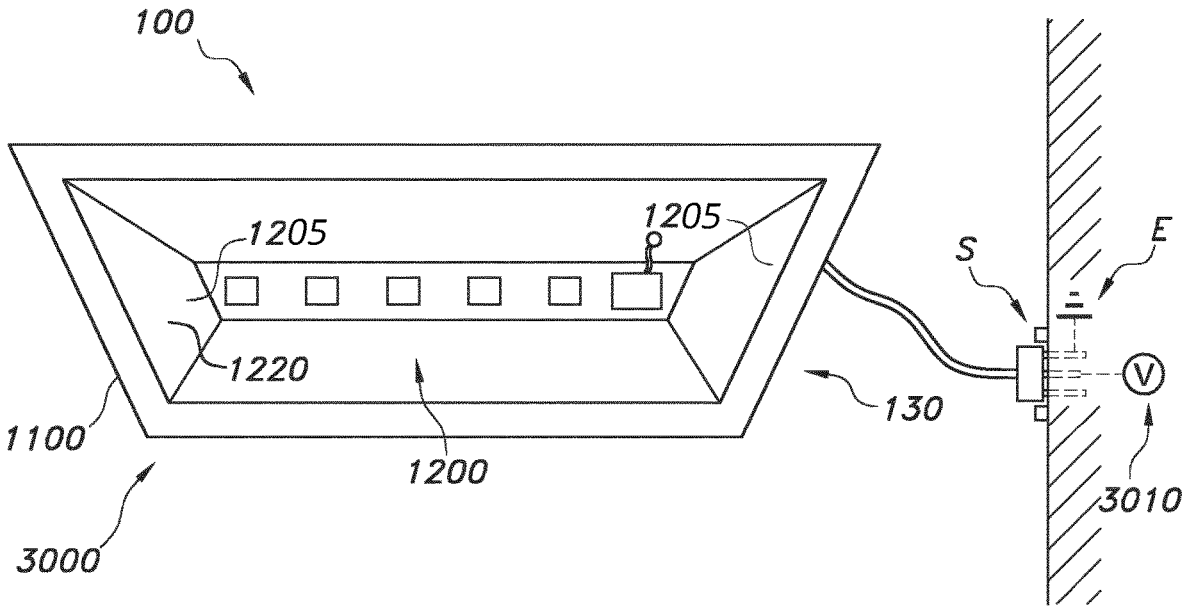

FIG. 4*e* schematically depicts an embodiment of a lighting system 3000 comprising the troffer-based lighting arrangement 100. The lighting unit 1200 is in functional connection with an electrical power system 3010. With such system 3000 the end plates 1100, the lighting unit 1200, and the head ends 1220 of the lighting unit 1200 each comprise a reflective face 1205 facing towards each other, and said head ends 1220 are in grounding continuity with said grounding point 1207. The grounding point 1207 is in grounding continuity with the earth E. Reference S indicates a socket.

Figure 4F:
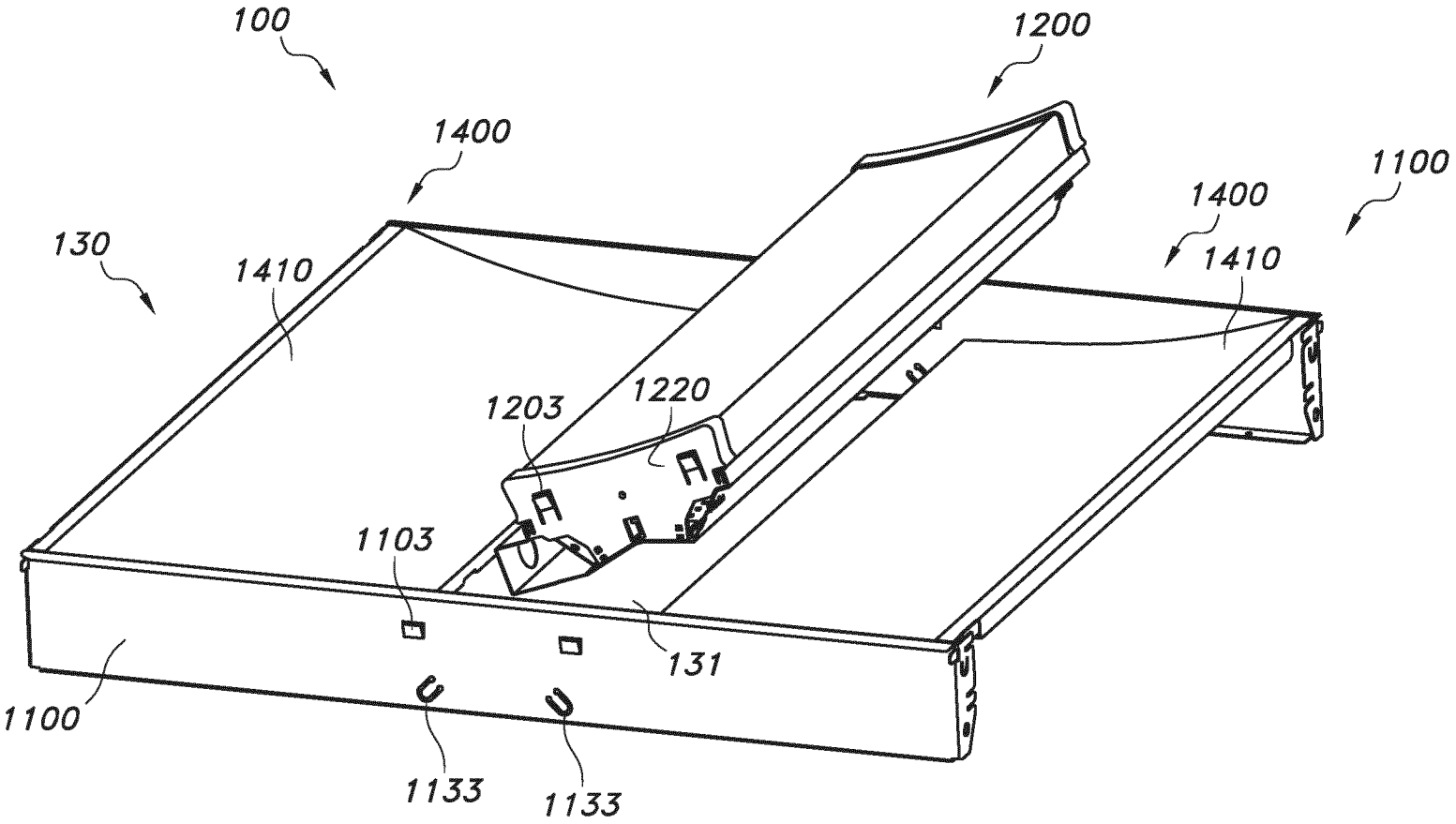
Figure 4G:
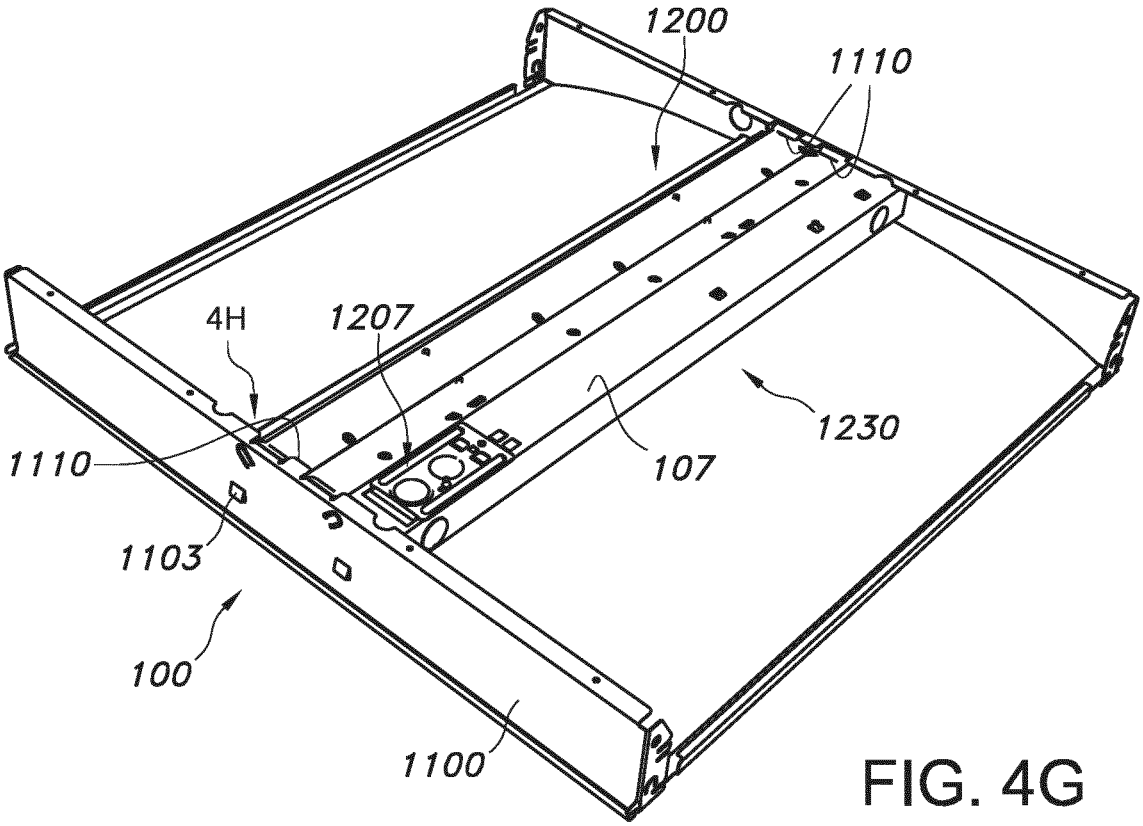
Figure 4H:
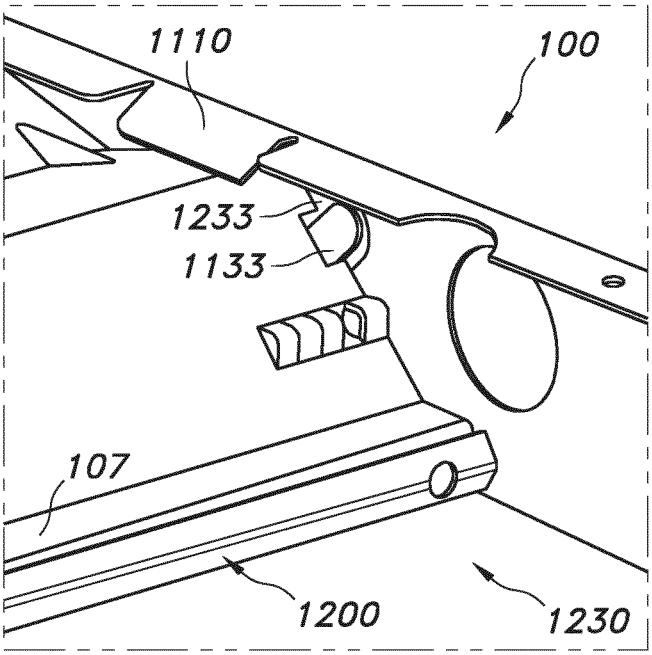

FIG. 4*f* shows an example how the lighting unit 1200 and end plates 1100 are engaged. FIG. 4*g* also shows such example, but now from the other side. The grounding point 1207 is also visible. This grounding point may be physically attached to a back plate, indicated with reference 107. The back plate, as indicate above, may essentially consist of metal (with a coating). FIG. 4*h* schematically depicts a detail of the embodiment of FIG. 4*g*, though this may also be used for other embodiments. FIG. 4*h* shows this part in another perspective than the part is shown in FIG. 4*g*. The protruding element(s) or lance(s) 1110 touch(es) the lighting unit 1200. Here the protruding element(s) touch the back plate 107. There may be a metal-metal contact, indicated with reference C, as the protruding element(s) appl(y)(ies) a force to the lighting unit 1200. Also a catch tab 1133 from the end plate 1100 residing in a cutout 1233 of the lighting unit 1200 is schematically displayed. This catch tab 1133 may provide an additional safety. Also this catch tab is especially in physical contact with the lighting unit. Here, the catch tab 1233 touches the back plate 107. There may also be a further metal-metal contact C in this way. Also here, scratching of the paint may create a permanent interference between the parts which insures continuity.

Hence, the physical contact between the lighting unit and end plate(s) for providing grounding continuity may amongst others be achieved with one or more of the protruding element(s) and the catch tab(s). The protruding element(s) are especially configured such, that there is a metal-metal (physical) contact between the lighting unit and end plates. Likewise, the catching tab and cutout are especially configured such, that there is a metal-metal (physical) contact between the lighting unit and end plates.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to". The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings.

The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A troffer-based lighting arrangement comprising end plates and a lighting unit configured between said end plates, wherein the lighting unit comprises a grounding point and head ends, wherein the end plates are associated with the respective head ends via connectors, wherein the lighting unit and end plates are in physical contact with each other for providing grounding continuity between the lighting unit and the end plates, and which connectors comprise head end locking tabs and end plate locking slots, wherein the locking tabs reside in the respective locking slots, the troffer-based lighting arrangement further comprising a troffer, wherein the troffer comprises side elements and said end plates defining a trough-like space for engaging at least part of said lighting unit, and wherein the lighting unit and said end plates are configured in interference fit for providing grounding continuity between the lighting unit and the end plates; wherein the end plates comprise protruding elements that protrude from the end plates and which are configured in interference fit with the lighting unit for providing grounding continuity between the lighting unit and the end plates.

2. A troffer-based lighting arrangement comprising end plates and a lighting unit configured between said end plates, wherein the lighting unit comprises a grounding point and head ends, wherein the end plates are associated with the respective head ends via connectors, wherein the lighting unit and end plates are in physical contact with each other for providing grounding continuity between the lighting unit and the end plates, and which connectors comprise head end locking tabs and end plate locking slots, wherein the locking tabs reside in the respective locking slots, the troffer-based lighting arrangement further comprising a troffer, wherein the troffer comprises side elements and said end plates defining a trough-like space for engaging at least part of said lighting unit, and wherein the lighting unit and said end plates are configured in interference fit for providing grounding continuity between the lighting unit and the end plates; wherein the lighting unit comprises a housing comprising cutouts, wherein the end plates comprise catching tabs, wherein the troffer-based lighting arrangement further comprises connectors which connectors provide grounding continuity between the lighting unit and the end plates, and which connectors comprise said catching tabs and cutouts configured in physical contact.

3. The troffer-based lighting arrangement according to claim 1, wherein each head end has a respective reflective face, said head ends facing each other with their reflective faces.

4. The troffer-based lighting arrangement according to claim 3, wherein the side elements comprise light reflective faces.

5. A troffer comprising side elements and end plates defining a trough-like space for engaging at least part of a lighting unit, wherein the end plates comprise end plate locking slots for engaging locking tabs comprised by said lighting unit, wherein the end plates comprise protruding elements that protrude from the end plates and which are configured for an interference fit with the lighting unit for providing grounding continuity between the lighting unit and the end plates.

6. The troffer according to claim 5, wherein the end plates further comprise catching tabs for providing together with cutouts in a housing of said lighting unit a physical contact configuration for providing grounding continuity between the lighting unit and the end plates.

7. The troffer according to claim 5, wherein the side elements and the end plates form a fully circumferential wall around the trough-like space.

8. A lighting unit comprising a grounding point and head ends, wherein the head ends comprise head end locking tabs for protruding locking slots of a troffer, which troffer comprises end plates, and which troffer is configured to engage at least part of said lighting unit, the lighting unit further comprising a housing, wherein the housing comprises cutouts for providing together with catching tabs of said troffer a physical contact configuration for providing grounding continuity between the lighting unit and the end plates.

9. A kit of parts comprising one or more of said troffers according to claim 5 and one or more lighting units, wherein at least one troffer and at least one lighting unit are configured to provide the troffer-based lighting arrangement.

10. A lighting system comprising the troffer-based lighting arrangement according to claim 1, wherein the lighting unit is in functional connection with an electrical power system, and wherein the end plates, the lighting unit, and the head ends of the lighting unit are in grounding continuity with said grounding point.

11. A method of assembling a troffer-based lighting arrangement, the method comprising providing the troffer according to 5 and the lighting unit, moving the lighting unit into the trough-like space until the locking tabs reside in the respective locking slots, wherein the end plates comprise protruding elements that protrude from the end plates, and wherein the method further comprises moving the lighting unit into the trough-like space until the lighting unit is in an interference fit with protruding elements.

* * * * *